US008113030B2

(12) United States Patent
Fujimura et al.

(10) Patent No.: US 8,113,030 B2
(45) Date of Patent: Feb. 14, 2012

(54) METHODS FOR MANUFACTURING FLANGED ARTICLE

(75) Inventors: Shirou Fujimura, Kariya (JP); Kouhei Ushida, Toyota (JP)

(73) Assignee: Toyota Boshoku Kabushiki Kaisha, Aichi (JP)

( * ) Notice: Subject to any disclaimer, the term of this patent is extended or adjusted under 35 U.S.C. 154(b) by 1021 days.

(21) Appl. No.: 11/915,896

(22) PCT Filed: Jun. 29, 2006

(86) PCT No.: PCT/JP2006/313451

§ 371 (c)(1),
(2), (4) Date: Feb. 29, 2008

(87) PCT Pub. No.: WO2007/004695

PCT Pub. Date: Jan. 11, 2007

(65) Prior Publication Data

US 2009/0025450 A1 Jan. 29, 2009

(30) Foreign Application Priority Data

Jul. 1, 2005 (JP) ..... 2005-193858
Apr. 4, 2006 (JP) ..... 2006-103242

(51) Int. Cl.
*B21D 31/00* (2006.01)
*B21D 43/28* (2006.01)
*B21D 22/00* (2006.01)
*B21J 13/00* (2006.01)

(52) U.S. Cl. ..... 72/377; 72/324; 72/355.2; 72/356

(58) Field of Classification Search ..... 72/324, 72/327, 329, 347–352, 353.2, 355.2, 355.6, 72/358–360, 377, 379.2; 29/893.36
See application file for complete search history.

(56) References Cited

U.S. PATENT DOCUMENTS

| | | | | |
|---|---|---|---|---|
| 4,477,537 | A | 10/1984 | Blase et al. | |
| 6,014,806 | A | 1/2000 | Ohya | |
| 6,729,172 | B2 | 5/2004 | Aizaki | |
| 6,907,764 | B2 | 6/2005 | Ushida | |
| 7,296,456 | B2 | 11/2007 | Ushida | |
| 2004/0187547 | A1 * | 9/2004 | Ushida | 72/356 |

FOREIGN PATENT DOCUMENTS

| | | |
|---|---|---|
| EP | 1038609 | 9/2000 |
| JP | 10 202329 | 8/1998 |
| JP | 11 330290 | 11/1999 |
| JP | 2000 117344 | 4/2000 |
| JP | 2003 80322 | 3/2003 |
| JP | 3429339 | 7/2003 |
| JP | 2003 305520 | 10/2003 |

OTHER PUBLICATIONS

English Language Abstract of JP 10-202329.
English Language Abstract of JP 11-330290.
English Language Abstract of JP 2000-117344.
English Language Abstract of JP 2003-80322.
English Language Abstract of JP 2003-305520.

* cited by examiner

*Primary Examiner* — Teresa Ekiert
(74) *Attorney, Agent, or Firm* — Greenblum & Bernstein, P.L.C.

(57) ABSTRACT

Methods are taught for manufacturing a work having a peripheral flange by pressing a sheet material may include half die cutting the material so as to simultaneously form inner and outer circumferential surface of the peripheral flange while the peripheral flange is simultaneously subjected to isostatic pressures that are directed from the flange inner surface to the flange outer surface or from the flange outer surface to the flange inner surface.

9 Claims, 7 Drawing Sheets

METHODS FOR MANUFACTURING FLANGED ARTICLE

TECHNICAL FIELD

The present invention relates to methods for manufacturing a flanged work or flanged article. More particularly, the present invention relates to methods for manufacturing a flanged article that includes a central depressed body coupled to a peripheral flange.

BACKGROUND ART

A known method for manufacturing a flanged article is taught, for example, by Japanese Laid-open Patent Publication Number 10-202329, in which a toothed recessed plate or ratchet plate for a seat reclining device of a vehicle is exemplified as a flanged article that can be prepared utilizing the known method. In this known art, a disk-like sheet material or sheet blank is placed and clamped between upper and lower dies of a press forming machine. Thereafter, a punch associated with the upper die is lowered by a predetermined distance toward a corresponding die opening defined within the lower die. As a result, the sheet material is press formed or half die cut, to thereby form the ratchet plate that comprises a central depressed body and a peripheral flange. The peripheral flange of the ratchet plate is integrally connected to the central body via an annular shear deformed connecting portion. As a result, the peripheral flange and the central body define a circular open cavity or recess. Further, two tooth forming edges are circumferentially defined on the punch. Therefore, a pair of toothed portions can be formed on the inner circular circumferential surface of the peripheral flange when the sheet blank is press formed.

Typically, the ratchet plate thus produced may be post-treated by utilizing a punching machine in order to trim or die cut the outer circumferential surface of the peripheral flange. However, when the ratchet plate is die cut by the punching machine, the peripheral flange may be subjected to a substantial shearing force. As a result, the peripheral flange may be partly deformed due to plastic flow. Such deformation of the peripheral flange may deform the toothed portions formed on the inner circumferential surface of the peripheral flange. This may lead to decreased accuracy or partial damage of the toothed portions.

DISCLOSURE OF INVENTION

It is, accordingly, one object of the present teachings to provide improved methods and apparatus for manufacturing flanged articles.

In one embodiment of the present teachings, methods are taught for manufacturing a work having a peripheral flange by pressing a sheet material. The method includes the step of half die cutting the material so as to simultaneously form inner and outer circumferential surface of the peripheral flange while the peripheral flange is simultaneously subjected to isostatic pressures that are directed from the flange inner surface to the flange outer surface or from the flange outer surface to the flange inner surface. The half die cutting step is performed so as to form an inner connecting portion that interconnect the flange and a base portion of the work and an outer connecting portion that interconnect the flange and a sheet material positioned outside the flange. Also, the half die cutting step is performed such that the outer connecting portion has a thickness thinner than the thickness of the inner connecting portion.

According to the present teachings, the peripheral flange may be press formed while isostatic pressures are oppositely applied thereto. The peripheral flange thus formed may have a smooth outer circumferential surface that is free from deformation and fracture. Therefore, the flanged article thus produced is not necessary to be post-treated in order to trim the outer circumferential surface of the peripheral flange. As a result, it is possible to produce the flanged article in which the peripheral flange may have highly accurate toothed portions.

Other objects, features and advantages of the present teachings will be readily understood after reading the following detailed description together with the accompanying drawings and the claims.

BEST MODE FOR CARRYING OUT THE INVENTION

Figure 5:
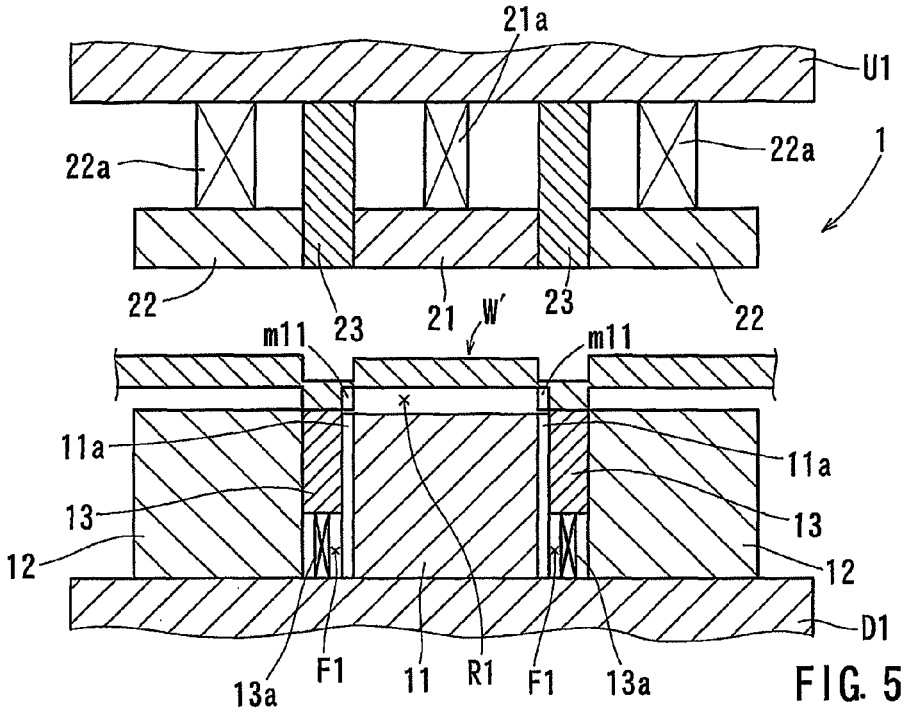
FIG. 5 is a vertical, cross-sectional view of the first pressing machine, illustrating a condition in which the upper die assembly is returned in order to remove the intermediate recessed plate from the first pressing machine.
Figure 6:
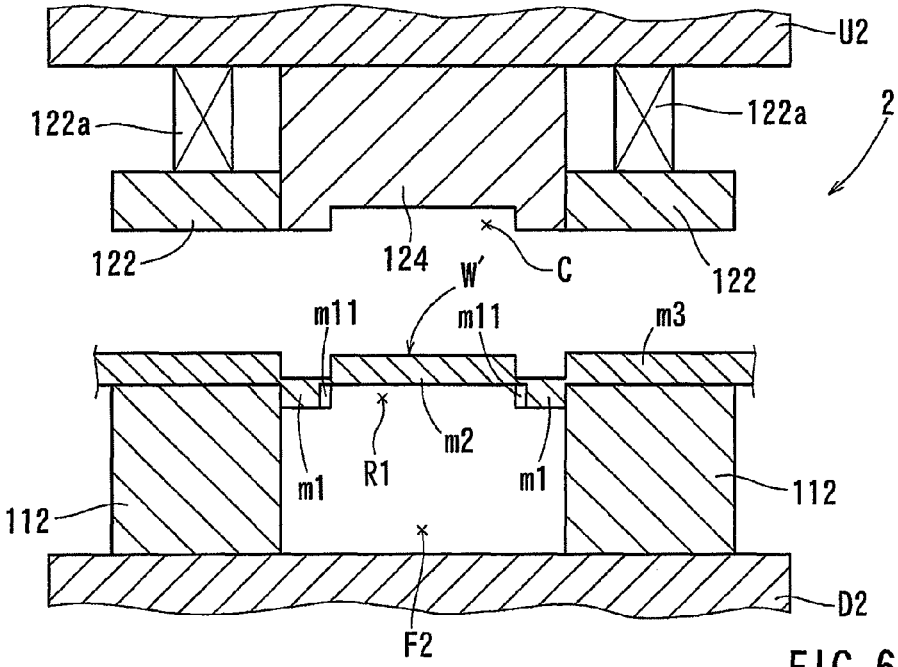
FIG. 6 is a vertical, cross-sectional view of a second pressing machine according to one representative embodiment of the present teachings, illustrating a condition in which the intermediate recessed plate is disposed on a lower die assembly.
Figure 7:
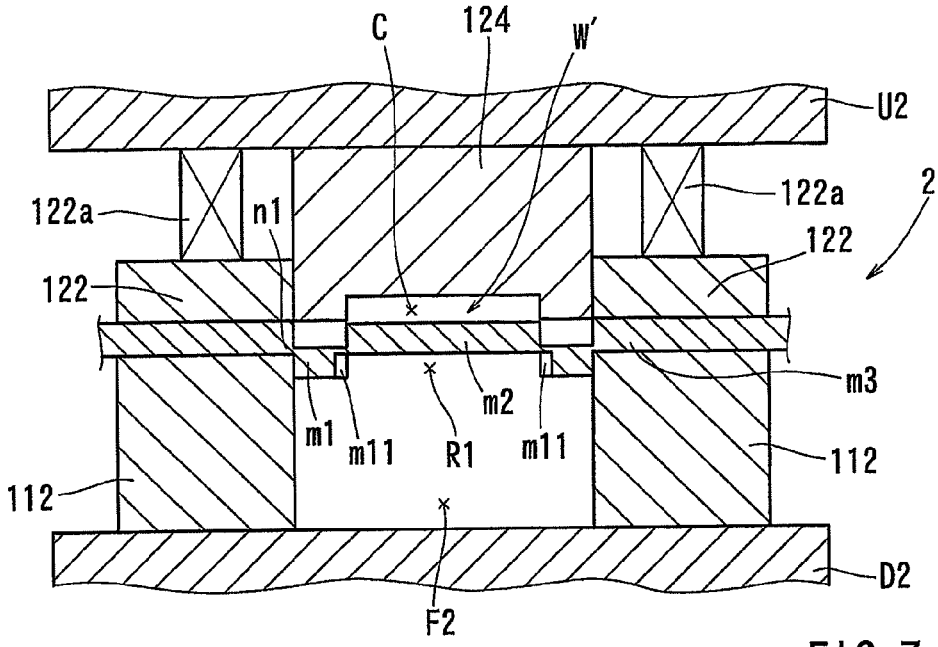
FIG. 7 is a vertical, cross-sectional view of the second pressing machine, illustrating a condition in which an upper die assembly is lowered in order to clamp the intermediate recessed plate between the upper and lower die assemblies.
Figure 8:
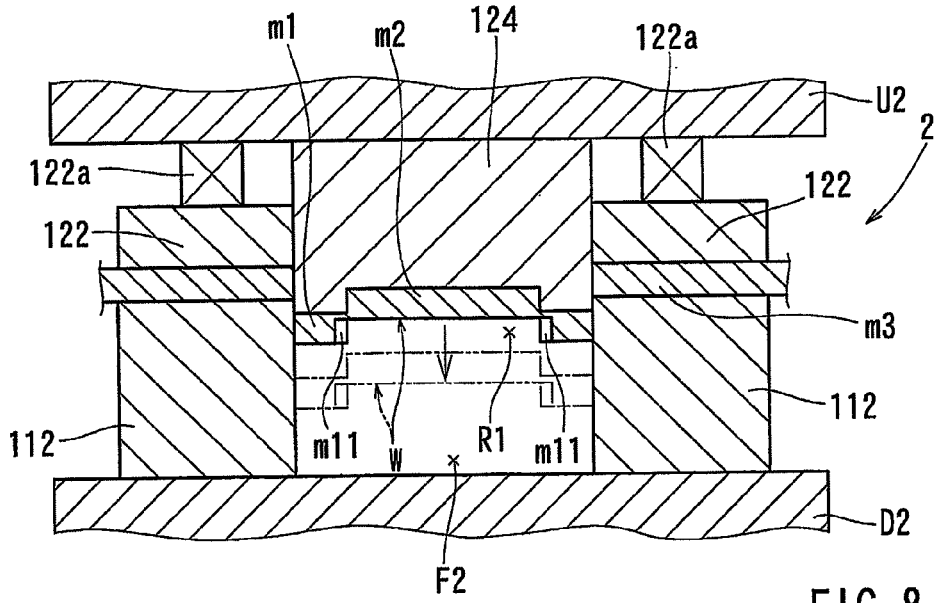
FIG. 8 is a vertical, cross-sectional view of the second pressing machine, illustrating a condition in which the intermediate recessed plate is die cut in order to form a recessed plate.
Figure 9:
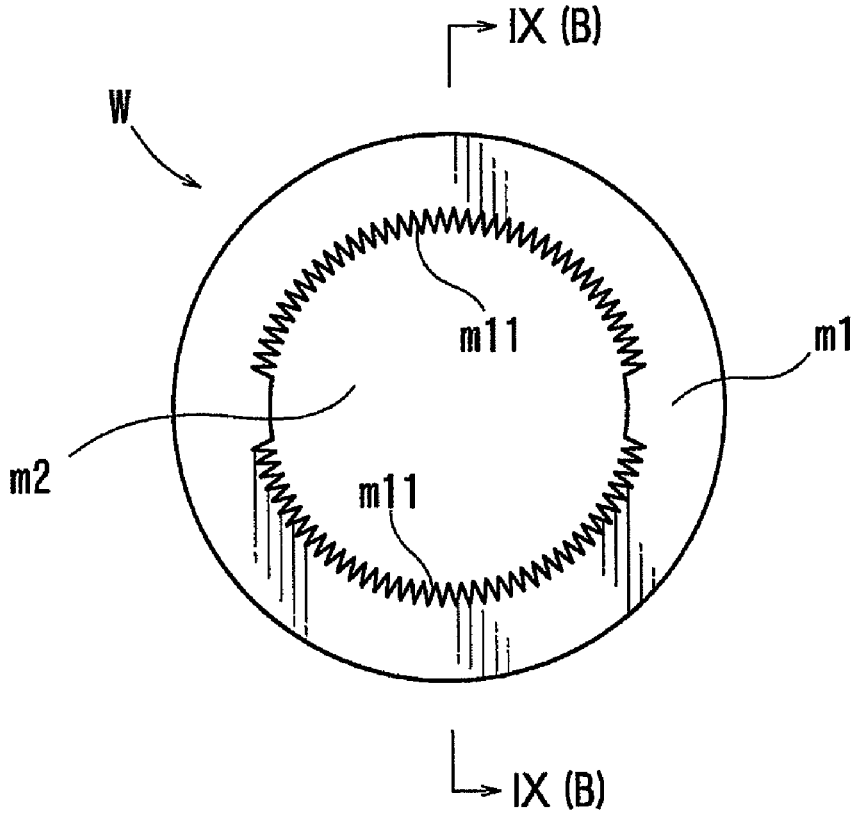
FIG. 9(A) is a plan view of the recessed plate.
FIG. 9(B) is a cross-sectional view taken along line IX(B)-IX(B) in FIG. 9(A).
Figure 9:
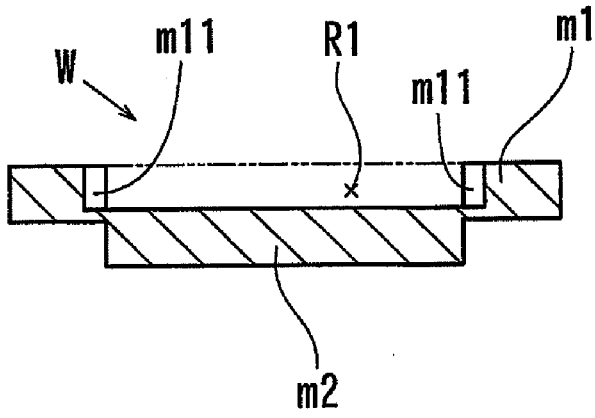

A detailed representative embodiment of the present teachings is shown in FIGS. 1 to 9(B), in which a circular dish-like toothed recessed plate W is exemplified in FIGS. 8, 9(A) and 9(B) as a flanged article that can be prepared utilizing the present teachings. Such a recessed plate W may be utilized, e.g., with a housing that defines a locking mechanism for a vehicle seat reclining device. The recessed plate (i.e., flanged article or work) W is preferably formed by processing a previously formed, intermediate toothed recessed plate (i.e., intermediate flanged article) W' (FIGS. 6-8). Further, the intermediate recessed plate W' is preferably formed by processing a sheet blank or sheet material M (FIGS. 1-5).

As shown in, for example, FIG. 4(A), the intermediate recessed plate W' as a primary product may preferably comprise a peripheral flange m1, a base portion or central circular depressed (offset) body m2 and a flange outer periphery m3 (i.e., a material portion positioned outside the flange or a material portion positioned outside the work). As best shown in FIG. 4(B), the peripheral flange m1 is integrally and continuously connected to the central body m2 via an annular shear deformed (inner) connecting portion n2. Consequently, the inner circular surface of the peripheral flange m1 and the lower surface of the central body m2 define a circular open cavity or recess R1 as shown in, for example, FIG. 5. In addition, two opposing toothed portions m11 are defined on the inner circular surface of the peripheral flange m1 as shown in, for example, FIG. 5. In addition, as best shown in FIG. 4(B), the peripheral flange m1 is integrally and continuously connected to the flange outer periphery m3 via an annular shear deformed (outer) connecting portion n1. Further, the connecting portion n1 may have a thickness of from 0.1 to 0.3 mm, and preferably 0.2 mm.

As shown in FIGS. 8, 9(A) and 9(B), the recessed plate W as a secondary product (or final product) may preferably be formed by simply removing or die cutting the flange outer periphery m3 from the intermediate recessed plate W'. Therefore, the recessed plate W may preferably comprise the central circular depressed (offset) body m2 and the peripheral flange m1. Similar to the intermediate recessed plate W', the peripheral flange m1 is integrally and continuously connected to the central body m2 via the annular shear deformed connecting portion n2, so that the inner circular surface of the peripheral flange m1 and the lower surface of the central body m2 define the circular open cavity or recess. R1. In addition, the two opposing toothed portions m11 are defined on the inner circular surface of the peripheral flange m1.

The intermediate recessed plate W' may be formed from the sheet material M by utilizing a first pressing machine 1 as shown in FIGS. 1-5. Thereafter, the intermediate recessed plate W' is preferably processed by utilizing a second pressing machine 2, to thereby form the recessed plate W as shown in FIGS. 6-8.

Figure 1:
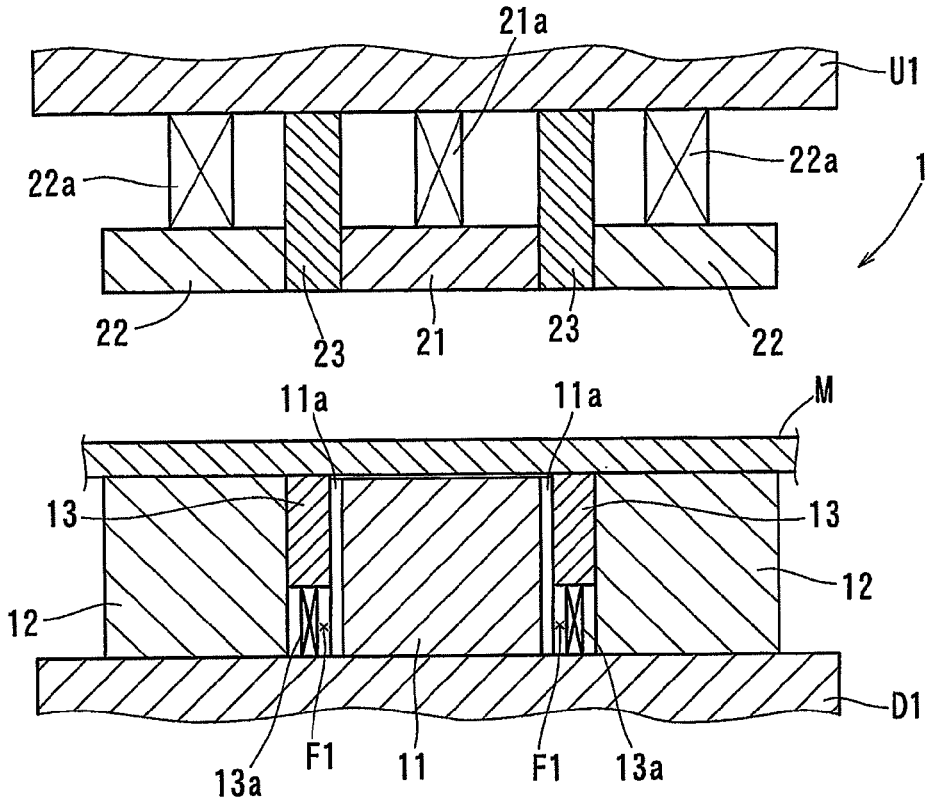
FIG. 1 is a vertical, cross-sectional view of a first pressing machine according to one representative embodiment of the present teachings, illustrating a condition in which a sheet material is disposed on a lower die assembly.
Figure 2:
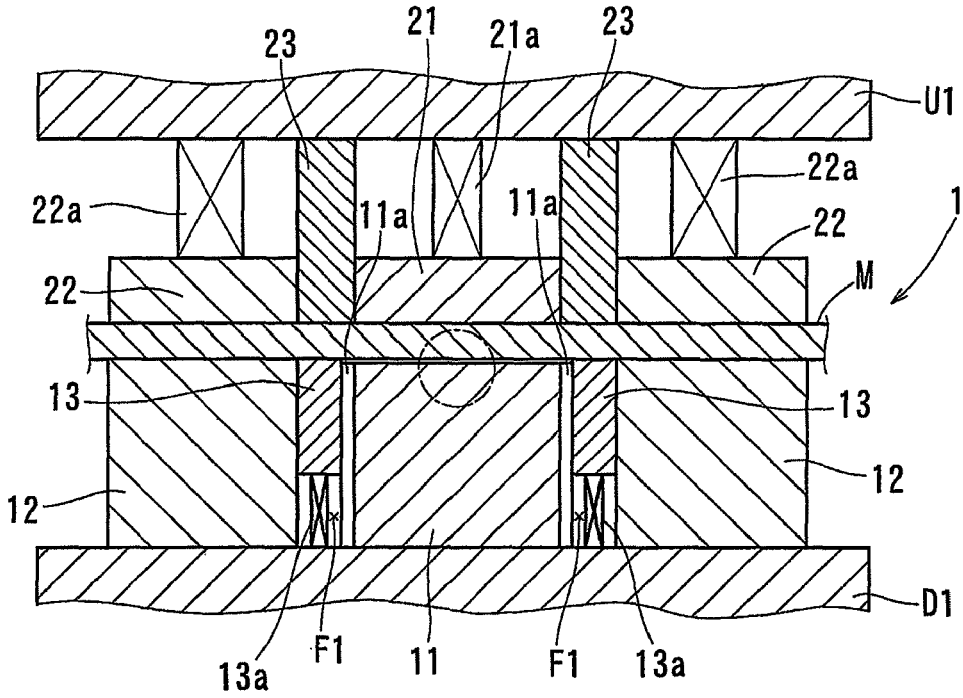
FIG. 2(A) is a vertical, cross-sectional view of the first pressing machine, illustrating a condition in which an upper die assembly is lowered in order to clamp the sheet material between the upper and lower die assemblies.
FIG. 2(B) is an enlarged view of an encircled portion in FIG. 2(A)
Figure 2:
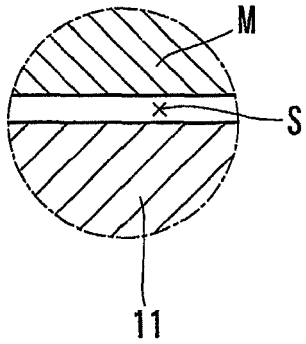

As shown in, for example, FIG. 1, the first pressing machine 1 may include a first upper die assembly that can move with respect to a first lower die assembly. The first upper die assembly may include a first upper die base U1. The first upper die assembly may further include an annular half die cutting die or punch 23 (i.e., a half die cutter) which constitutes a second set of pressing members, a disk-shaped ejector plate 21 (i.e., a first biasing member) which constitutes a first set of pressing members, and an annular stripper plate 22 (i.e., a second biasing member) which constitutes a third set of pressing members. The annular punch 23 is fixedly connected to the lower surface of the first upper die base U1, so as to move together with the first upper die assembly (the first upper die base U1). The ejector plate 21 is closely positioned within the annular punch 23. The ejector plate 21 is movably attached to the lower surface of the first upper die base U1 via an elastic member 21*a* (e.g., a gas spring and a compression spring), so as to vertically move along the annular punch 23. The elastic member 21*a* is arranged and constructed such that the ejector plate 21 is normally biased or forced downwardly. The stripper plate 22 is positioned around the annular punch 23, so as to closely surround the same. Similar to the ejector plate 21, the stripper plate 22 is movably attached to the lower surface of the first upper die base U1 via an elastic member 22*a* (e.g., a gas spring and a compression spring), so as to vertically move along the annular punch 23. Similar to the elastic member 21*a*, the elastic member 22*a* is arranged and constructed such that the ejector plate 21 is normally biased or forced downwardly. As will be appreciated, the annular punch 23, the ejector plate 21 and the stripper plate 22 may preferably be arranged and constructed such that their lower surfaces are normally coplanar with each other.

The first lower die assembly may include a first lower die base D1. The first lower die assembly may further include an annular die 12 (i.e., a second die element) which constitutes a third set of pressing members, an annular ejector member 13 (i.e., a counter biasing member) which constitutes a second set of pressing members and a cylindrical die 11 (i.e., a first die element) which constitutes a first set of pressing members. The annular die 12 is fixedly connected to the upper surface of the first lower die base D1, so as to align with the annular stripper plate 22 of the first upper die assembly. The annular die 12 may preferably define a cylindrical die opening F1 therewithin, the die opening being concentric with the annular punch 23 of the first upper die assembly. The annular die 12 may preferably be constructed such that the die opening F1 has a diameter that is slightly greater than the outer diameter of the annular punch 23, so as to receive the annular punch 23. The cylindrical die 11 is positioned within the die opening F1 so as to be coaxially aligned with the annular punch 23. That is, the cylindrical die 11 is positioned so as to be vertically opposite to the ejector plate 21 of the first upper die assembly, so that a cylindrical annular space is formed between the dies 11 and 12. The cylindrical die 11 is fixedly connected to the upper surface of the first lower die base D1. The annular ejector member 13 is positioned within the annular space between the dies 11 and 12, so as to contact both of the cylindrical surfaces of the dies 11 and 12. The ejector member 13 thus positioned is coaxially aligned with the annular punch 23. That is, the ejector member 13 is vertically opposite to the annular punch 23. Further, the ejector member 13 is movably attached to the upper surface of the first lower die base D1 via an elastic member 13*a* (e.g., a gas spring and a compression spring), so as to vertically move along the annular die 12 and the cylindrical die 11. The elastic member 13*a* is arranged and constructed such that the ejector member 13 is normally biased or forced upwardly. As will be appreciated, the annular die 12 and the ejector member 13 may preferably be arranged and constructed such that their upper surfaces are normally coplanar with each other.

The cylindrical die 11 is preferably structured so as to have substantially the same shape as the recess R1 that will be formed within the intermediate recessed plate W' (the recessed plate W). In addition, the cylindrical die 11 may preferably be arranged and constructed such that its upper surface (i.e., a die surface) is slightly lower than the upper surfaces (i.e., die surfaces) of the annular die 12 and the ejector member 13, so that difference in level is formed therebetween. Also, tooth forming edges 11*a* may be disposed around the circumference of the cylindrical die 11. The tooth forming edges 11*a* preferably correspond to the two opposing toothed portions m11 that will be formed along the inner circular surface of the peripheral flange m1. Further, as best shown in FIG. 4(B), the ejector member 13 may preferably have a thickness smaller than the thickness of the annular punch 23. The ejector member 13 can be designed such that the difference between the thickness of the ejector member 13 and the thickness of the annular punch 23 substantially corresponds to the depth of the tooth forming edges 11*a* of the cylindrical die 11.

As shown in, for example, FIG. 6, the second pressing machine 2 may include a second upper die assembly that can move with respect to a second lower die assembly. The upper die assembly may include a second upper die base U2. The second upper die assembly may further include a cylindrical cutting die or punch 124 (i.e., a die cutter) and an annular stripper plate 122 (i.e., a third biasing member). The cylindrical punch 124 is fixedly connected to the lower surface of the second upper die base U2, so as to move together with the second upper die assembly (the second upper die base U2). As will be appreciated, the cylindrical punch 124 may preferably have the same outer diameter as the outer diameter of the annular punch 23 of the first pressing machine 1. Further, the cylindrical punch 124 may preferably have an open cavity or recess C formed in the lower surface thereof. The recess C is arranged and constructed to fit over the central circular depressed body m2 of the intermediate recessed plate W'. The stripper plate 122 is positioned around the cylindrical punch 124, so as to closely surround the same. Similar to the stripper plate 22 of the first pressing machine 1, the stripper plate 122 is movably attached to the lower surface of the second upper die base U2 via an elastic member 122*a* (e.g., a gas spring and a compression spring), so as to vertically move along the cylindrical punch 124. The elastic member 122*a* is arranged and constructed such that the stripper plate 122 is normally biased or forced downwardly.

The second lower die assembly may include a second lower die base D2. The second lower die assembly may further include an annular die 112 (i.e., a third die element). The annular die 112 is fixedly connected to the upper surface of the second lower die base D2, so as to align with the annular stripper plate 122 of the second upper die assembly. The annular die 112 may preferably define a cylindrical die opening F2 therewithin, the die opening being axially aligned with the cylindrical punch 124 of the second upper die assembly. The annular die 112 may preferably have an inner diameter substantially equal to the outer diameter of the cylindrical punch 124, so that the die opening F2 defined therewithin can closely receive the cylindrical punch 124 when the second upper die assembly is lowered (FIG. 8).

A representative method for manufacturing the recessed plate W using the first and second pressing machines 1 and 2 will now be described. As shown in FIG. 1, the sheet material M is first disposed on the first lower die assembly of the first pressing machine 1. That is, the sheet material M is disposed on the annular die 12 and the ejector member 13 of the first pressing machine 1. Subsequently, as shown in FIG. 2(A), the upper base U1 of the first upper die assembly of the first pressing machine 1 is moved (lowered) until the annular punch 23, the annular stripper plate 22 and the ejector plate 21 contact the upper surface of the sheet material M. As a result, the sheet material M is clamped between the annular stripper plate 22 and the annular die 12 and between the annular punch 23 and the ejector member 13. At this time, as shown in FIG. 2(B), a space S is formed between the sheet material M and the upper surface of the cylindrical die 11, because the upper surface of the cylindrical die 11 is slightly lower than the upper surfaces of the annular die 12 and the ejector member 13 as described above (i.e., the difference in level is formed therebetween).

Figure 3:
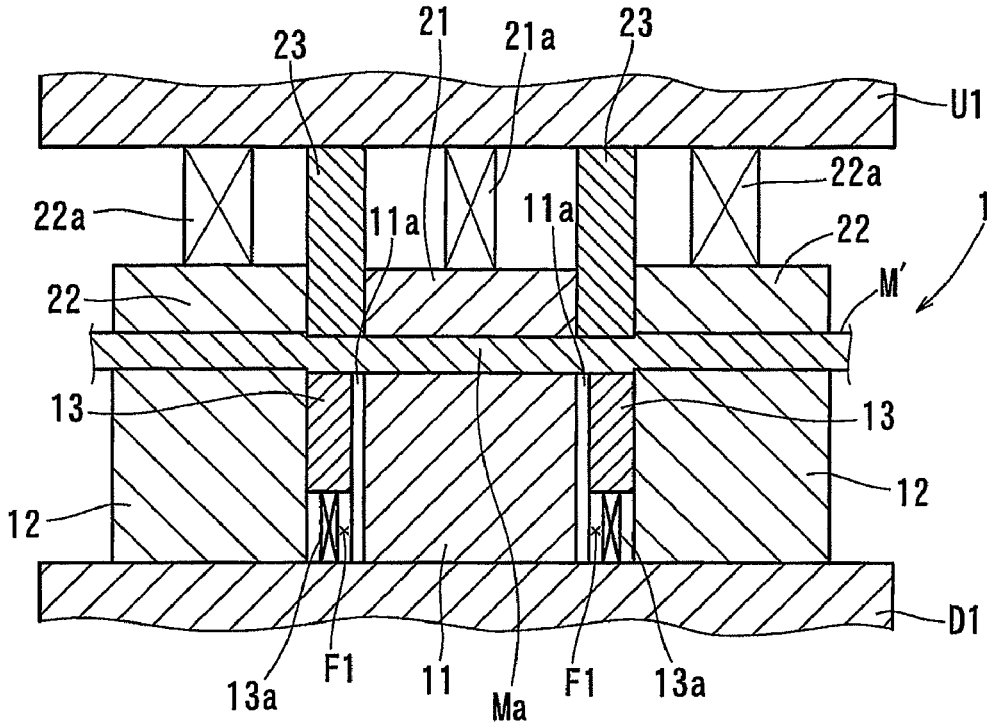
FIG. 3 is a vertical, cross-sectional view of the first pressing machine, illustrating a condition in which the sheet material is preformed in order to form a preformed sheet material.
Figure 4:
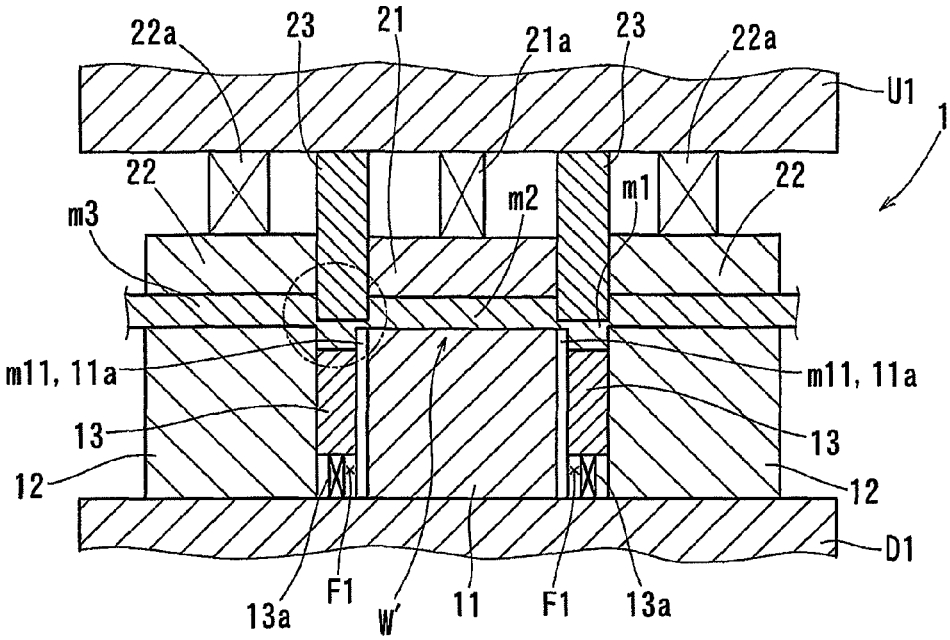
FIG. 4(A) is a vertical, cross-sectional view of the first pressing machine, illustrating a condition in which the preformed sheet material is half die cut in order to form an intermediate recessed plate.
FIG. 4(B) is an enlarged view of an encircled portion in FIG. 4(A)
Figure 4:
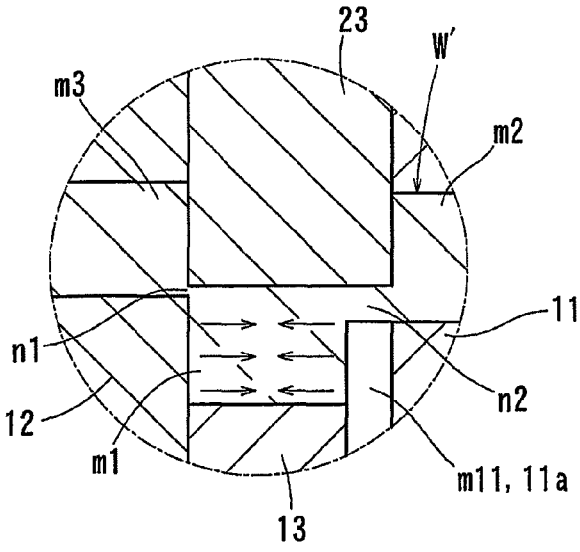

Thereafter, as shown in FIG. 3, the first upper die assembly (the upper base U1) is further moved toward the first lower die assembly. As a result, the annular punch 23 will be moved downwardly against the elastic force of the elastic member 13*a*, so that the sheet material M is preformed (shear press formed) by cooperation of the annular punch 23 and the annular die 12, to thereby form a preformed sheet material M' as a preformed material (a first half die cutting step). At this time, the ejector plate 21 is lowered together with the annular punch 23. Conversely, the stripper plate 22 may be upwardly moved along the annular punch 23 so as to elastically deform the elastic member 22*a*. As a result, the stripper plate 22 may be downwardly biased due to the elastic force of the deformed elastic member 22*a*, so as to provide compression forces to the preformed sheet material M'. As will be recognized, this preforming operation may preferably be continued until the sheet material M contacts the upper surface of the cylindrical die 11. That is, the first upper die assembly is moved downwardly until the space S disappears (or decreases to zero). Therefore, the preformed sheet material M' may have a depressed (offset) portion Ma having offsets that correspond to the space S.

After completing the preforming operation, as shown in FIG. 4(A), the first upper die assembly is further moved toward the first lower die assembly. As a result, the annular punch 23 will be further moved downwardly against the elastic force of the elastic member 13*a*, so that the preformed sheet material M' is shear press formed or half die cut by cooperation of the annular punch 23 and the annular die 12 and the cylindrical die 11, to thereby form the intermediate recessed plate W' as the primary product (a second half die cutting step). As previously described, the intermediate recessed plate W' thus produced includes the peripheral flange m1, the central circular depressed body m2 and the flange outer periphery m3 that are interconnected via the connecting portions n1 and n2 (FIG. 4(B)). At this time, both of the ejector plate 21 and the stripper plate 22 may be upwardly moved along the annular punch 23 so as to elastically deform the elastic members 21*a* and 22*a*. As a result, the ejector plate 21 and the stripper plate 22 may be downwardly biased due to the elastic force of the deformed elastic members 21*a* and 22*a*, so as to provide compression forces to the intermediate recessed plate W'. Further, when the preformed sheet material M' is press formed, the toothed portions m11 are simultaneously formed along the inner circular surface of the peripheral flange m1, because the tooth forming edges 11*a* are defined around the circumference of the cylindrical die 11.

This shear press forming operation may preferably be continued until the connecting portions n1 and n2 may respectively have a desired or predetermined thickness. As best shown in FIG. 4(B), the connecting portions n1 and n2 may respectively have a different thickness, because the preformed sheet material M' has the depressed portion Ma having the offsets that correspond to the space S. In other words, the connecting portion n1 has a thickness thinner than the thickness of the connecting portion n2. As will be appreciated, the difference between the thicknesses of these connecting portions n1 and n2 is substantially equal to the height of the space S.

Further, in the first and second half die cutting steps, the half die cutting operation that is performed by the annular punch 23 and the annular die 12 will be referred to as an outer half die cutting step. Conversely, the half die cutting operation that is performed by the annular punch 23 and the cylindrical die 11 will be referred to as an inner half die cutting step. As will be appreciated, the inner and outer half die cutting steps may respectively form the inner and outer circular surfaces of the peripheral flange m1.

As described above, the shear press forming operation can be performed by lowering the first upper die assembly toward the first lower die assembly and not by lifting the first lower die assembly toward the first upper die assembly. In other words, the annular punch 23 can be moved utilizing the weight of the first upper die assembly in order to half die cut the preformed sheet material M'. Therefore, additional forces that are required to move the annular punch 23 can be effectively reduced.

In addition, according to the present shear press forming operation, the peripheral flange m1 of the intermediate recessed plate W' can be formed while it is transversely restrained between the cylindrical die 11 and the annular die 12. Therefore, the peripheral flange m1 may be prevented from bending or deforming that is caused by plastic deformation. In addition, the peripheral flange m1 may preferably be subjected to isostatic pressures that are directed radially inward and outward (i.e., in the directions shown by arrow in FIG. 4(B)). Therefore, the peripheral flange m1 may have a smooth outer surface that is free from deformation and fracture.

After completing the shear press forming operation, as shown in FIG. 5, the first upper die assembly is moved upwardly so as to be away from the first lower die assembly. As a result, the ejector plate 21 and the stripper plate 22 will be downwardly returned to their resting positions due to the elastic forces of the elastic members 21*a* and 22*a*, so that the intermediate recessed plate W' will be disengaged from the annular punch 23. At the same time, the ejector member 13 of the first lower die assembly will be upwardly returned to its resting position due to the elastic force of the elastic member 13*a*, so as to upwardly eject the intermediate recessed plate W' from the die opening F1 of the first lower die assembly. Thus, the intermediate recessed plate W' will be removably positioned on the first lower die assembly while the peripheral flange m1 is supported via the ejector member 13.

The intermediate recessed plate W' thus produced is then processed by utilizing the second pressing machine 2. That is, as shown in FIG. 6, the intermediate recessed plate W' is placed on the second lower die assembly (the annular die 112) of the second pressing machine 2 while the peripheral flange m1 is positioned within the cylindrical die opening F2 of the annular die 112. At this time, the flange outer periphery m3 is seated on the annular die 112. Subsequently, as shown in FIG. 7, the upper base U2 of the second upper die assembly of the second pressing machine 2 is moved (lowered) until the annular stripper plate 122 contacts the upper surface of the flange outer periphery m3. Thus, the flange outer periphery m3 is clamped between the annular stripper plate 122 and the annular die 112, so that the intermediate recessed plate W' is immovably positioned on the second lower die assembly.

Thereafter, the second upper die assembly is further moved toward the second lower die assembly. As a result, the cylindrical punch 124 will be moved downwardly, so that the recess C formed in the lower surface of the cylindrical punch 124 fits over the central circular depressed body m2 of the intermediate recessed plate W'. At this time, the stripper plate 122 may provide compression forces to the flange outer periphery m3 due to the elastic force of the elastic member 122*a*, so that the flange outer periphery m3 can be rigidly clamped between the annular stripper plate 122 and the annular die 112.

Subsequently, as shown in FIG. 8, the second upper die assembly is further moved toward the second lower die assembly. As a result, the cylindrical punch 124 will be projected into the die opening F2 so as to engage the annular punch 112. Upon engagement of the cylindrical punch 124 and the annular punch 112, the connecting portion n1 connecting the peripheral flange m1 and the flange outer periphery m3 is die cut along the outer circular surface of the peripheral flange m1, so that the recessed plate W is formed as the final product.

At this time, the stripper plate 122 may further provide compression forces to the flange outer periphery m3 due to the elastic forces of the elastic members 122*a*, because the elastic member 122*a* is further elastically deformed. Therefore, the flange outer periphery m3 can be further rigidly clamped between the annular stripper plate 122 and the annular die 112, so as to be effectively prevented from deforming (plastically deforming) when the connecting portion n1 is die cut. As a result, the peripheral flange m1 may have a smooth die cut surface that is free from deformation and fracture.

Further, because the connecting portion n1 has a reduced thickness as described above, the connecting portion n1 can be easily die cut by exerting limited forces thereon. Also, upon completion of the die cutting operation, the produced recessed plate W may fall into the cylindrical die opening F2 of the annular die 112 as a result of gravity. Therefore, the recessed plate W can be easily removed from the second pressing machine 2 by simply returning the second upper die assembly to its resting position (an uppermost position).

According to the present method, the sheet material M is half die cut in the first pressing machine 1, to thereby form the intermediate recessed plate W' having the peripheral flange m1. Also, when the intermediate recessed plate W' is formed, the toothed portions m11 are simultaneously formed along the inner circular surface of the peripheral flange m1.

In addition, the connecting portion n1 of the intermediate recessed plate W' is die cut in the second pressing machine 2 in order to separate the flange outer periphery m3 from the peripheral flange m1, to thereby form the recessed plate W. As previously described above, because the connecting portion n1 can be easily die cut without exerting large forces thereon, such die cutting operation does not lead to decreased accuracy or partial damage of the toothed portions m11 that are formed in the inner circumferential surface of the peripheral flange m1.

Further, according to the present invention, the half die cutting operation and the die cutting operation can respectively be completed using the first and second pressing machines 1 and 2. Therefore, it is not necessary to use additional machines such as a special cutting machine. As a result, it is possible to reduce manufacturing steps and manufacturing costs for the recessed plate W.

Naturally, various changes and modifications may be made to the present teachings without departing from the scope of the invention. For example, in the above described embodiment, the half die cutting operation and the die cutting operation are performed using the first and second (two) pressing machines 1 and 2. However, the half die cutting operation and the die cutting operation can be performed using a single common pressing machine. For example, both of the half die cutting and the die cutting operations can be performed using only the first pressing machine 1. In such a case, the first pressing machine 1 is designed such that the first upper and lower die assemblies (the first upper and lower die bases U1 and D1) can be optionally replaced with the second upper and lower die assemblies (the second upper and lower die bases U2 and D2) after the half die cutting operation is completed. Alternatively, the first pressing machine 1 is designed so as to include the second upper and lower die assemblies (the second upper and lower die bases U2 and D2). In addition, the second upper and lower die assemblies can respectively be combined with the first upper and lower die assemblies. For example, it is possible to use the first upper and lower die bases U1 and D1 as common upper and lower die bases and to omit the second upper and lower die bases U2 and D2.

A representative example of the present invention has been described in detail with reference to the attached drawings.

This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the foregoing detail description may not be necessary to practice the invention in the broadest sense, and are instead taught merely to particularly describe detailed representative examples of the invention. Moreover, the various features taught in this specification may be combined in ways that are not specifically enumerated in order to obtain additional useful embodiments of the present teachings.

Additional examples of methods for manufacturing a flanged article are found in U.S. Pat. No. 6,907,764, the contents of which are hereby incorporated by reference.

The invention claimed is:

1. A method for manufacturing a work having a peripheral flange by pressing a sheet material, comprising:

half die cutting the sheet material so as to simultaneously form inner and outer circumferential surfaces of the peripheral flange while the peripheral flange is simultaneously subjected to isostatic pressures that are directed from at least one of a flange inner surface to a flange outer surface and from the flange outer surface to the flange inner surface, wherein a toothed portion is defined on the flange inner surface, and wherein when the half die cutting is performed, an inner connecting portion that interconnects the peripheral flange and a base portion of the work is formed such that the peripheral flange annularly encircles the base portion, an outer connecting portion that interconnects the peripheral flange and a material portion positioned outside the peripheral flange is formed, and the outer connecting portion has a thickness thinner than a thickness of the inner connecting portion.

2. The method for manufacturing the work defined in claim 1, further comprising:

die cutting the outer connecting portion by applying an external force to a surface of the peripheral flange.

3. A method for manufacturing a work by pressing a sheet material, the work having a peripheral flange and a base portion that are integral with and offset from each other, comprising:

inner half die cutting the sheet material in its a thickness direction by utilizing a first set of pressing members clamping the base portion therebetween and a second set of pressing members clamping the peripheral flange therebetween; and outer half die cutting the sheet material in the thickness direction simultaneously during the inner half die cutting by additionally utilizing a third set of pressing members clamping the sheet material therebetween at a position that defines a contour of the peripheral flange, wherein the outer half die cutting has a degree of cutting greater than a degree of cutting of the inner half die cutting.

4. A method for manufacturing a work having a peripheral flange by pressing a sheet material, comprising:

first half die cutting the sheet material such that a work forming portion can be offset in a thickness direction of the sheet material; and second half die cutting the sheet material after the first half die cutting such that a portion corresponding to the peripheral flange can be further offset in the thickness direction, wherein during the second half die cutting, a relative position of the sheet material positioned outside of the work forming portion formed during the first half die cutting is maintained.

5. The method for manufacturing the work defined in claim 4, wherein the pressing is performed using a lower die assembly and an upper die assembly that is positioned so as to be opposite to the lower die assembly, the lower die assembly includes a first die element to hold a lower surface of a base portion of the work and a second die element to hold a lower surface of the material portion positioned outside the peripheral flange, the first die element having a die surface that is lower than a die surface of the second die element, thereby forming a difference in level therebetween, and wherein during the first half die cutting, the upper die assembly facing the base portion and a flange outer periphery presses the sheet material until a lower surface of the sheet material contacts the die surface of the first die element and the die surface of the second die element, so that the work forming portion is offset by the difference in level.

6. A method for manufacturing a work by pressing a sheet material, the work having a peripheral flange and a base portion that are integral with and offset from each other, comprising:

providing a first set of pressing members clamping the base portion therebetween, a second set of pressing members clamping the peripheral flange therebetween, and a third set of pressing members clamping the material at a position that defines a contour of the peripheral flange;

moving the first and second sets of pressing members relative to the third set of pressing members in a direction of thickness of the sheet material, thereby first half die cutting the sheet material; and further moving the second set of pressing members relative to the first and third sets of pressing members in the direction of thickness as the first half die cutting, thereby second half die cutting the sheet material, wherein the first and second half die cutting are continued until a connecting portion connecting the peripheral flange and the sheet material has a predetermined thin thickness.

7. The method for manufacturing the work defined in claim 6, wherein in an initial state, the distance between the pressing members in the first set of pressing members is greater than the distance between the pressing members in the third set of pressing members, and wherein the pressing members in respective sets of pressing members are moved relative to each other so as to reduce the difference of the distances, thereby performing the first half die cutting.

8. A method for manufacturing a work by pressing a sheet material using a lower die assembly and an upper die assembly that is positioned so as to be opposite to the lower die assembly, the work having an annular peripheral flange and a base portion encircled by the peripheral flange that are integral with and offset from each other, the lower die assembly comprising:

a first die element to hold a lower surface of the base portion, a second die element to hold a lower surface of a flange outer periphery, a counter biasing member that is vertically movably received between the first and second die elements and is constructed to upwardly bias a lower surface of the peripheral flange, a pressing surface of the first die element being different from a pressing surface of the second die element, thereby forming a difference in level therebetween, the upper die assembly comprising:

a first biasing member to compress an upper surface of the base portion, a second biasing member to compress an upper surface of the flange outer periphery, and an annular punch for half die cutting an upper surface of the peripheral flange, the method comprising:

half die cutting the sheet material corresponding to a work forming portion for a desired depth using the first biasing member and the annular punch;

half die cutting the upper surface of the peripheral flange using the annular punch while pressing the upper surface of the base portion by the first biasing member;

pressing the upper surface of the flange outer periphery by the second biasing member;

upwardly biasing the lower surface of the peripheral flange via the counter biasing member; and forming toothed portions along an inner circumferential surface of the peripheral flange using a tooth forming edge disposed around a circumference of the first die element.

9. The method for manufacturing the work defined in claim 8, further comprising:

die cutting a connecting portion by applying an external force to a surface of the peripheral flange.

* * * * *